United States Patent [19]

Kitamura et al.

[11] Patent Number: 4,683,795

[45] Date of Patent: Aug. 4, 1987

[54] PERIODIC WAVE FORM GENERATION BY RECYCLICALLY READING AMPLITUDE AND FREQUENCY EQUALIZED DIGITAL SIGNALS

[75] Inventors: Masatsugu Kitamura, Atsugi; Kikuji Wagatsuma, Sagamihara; Tokumi Watanabe, Tokyo; Naoki Yamashita, Tokyo; Hiroshi Yoshida, Tokyo, all of Japan

[73] Assignee: Victor Company of Japan, Japan

[21] Appl. No.: 925,477

[22] Filed: Oct. 31, 1986

Related U.S. Application Data

[63] Continuation of Ser. No. 664,490, Oct. 24, 1984, abandoned.

[30] Foreign Application Priority Data

Oct. 28, 1983 [JP] Japan ..... 58-202407
Nov. 10, 1983 [JP] Japan ..... 58-211345

[51] Int. Cl.[4] ..... G10H 1/02; G10H 7/00

[52] U.S. Cl. ..... 84/1.26; 84/1.13; 364/419; 364/718

[58] Field of Search ..... 84/1.01, 1.03, 1.13, 84/1.19–1.21, 1.26; 364/419, 718

[56] References Cited

U.S. PATENT DOCUMENTS

| | | | |
|---|---|---|---|
| 3,662,163 | 5/1972 | Miller et al. . | |
| 3,763,364 | 10/1973 | Deutsch et al. | 84/1.03 X |
| 4,149,440 | 4/1979 | Deforeit . | |
| 4,164,020 | 8/1979 | Griffith . | |
| 4,267,579 | 5/1981 | Gross . | |
| 4,326,260 | 4/1982 | Gross . | |
| 4,442,745 | 4/1984 | Gross et al. | 84/1.26 X |
| 4,496,937 | 1/1985 | Kitagawa et al. . | |
| 4,502,361 | 3/1985 | Viitanen et al. | 84/1.26 |
| 4,520,708 | 6/1985 | Wachi | 84/1.26 |
| 4,524,666 | 6/1985 | Kato | 84/1.26 X |
| 4,573,389 | 3/1986 | Suzuki | 84/1.26 |

FOREIGN PATENT DOCUMENTS

| | | |
|---|---|---|
| 3430850 | 3/1985 | Fed. Rep. of Germany . |
| 81/03236 | 11/1981 | PCT Int'l Appl. . |
| 2129996 | 5/1984 | United Kingdom . |

*Primary Examiner*—S. J. Witkowski
*Attorney, Agent, or Firm*—Lowe, Price, LeBlanc, Becker & Shur

[57] ABSTRACT

An electronic musical instrument includes a memory in which digital samples of an aperiodic waveform are stored. Digital samples stored in a first portion of the memory represent a rapidly rising portion of the waveform and those stored in a second portion of the memory represent a rapidly declining portion of the waveform whose amplitude and spectral energy distributions are equalized. The first memory portion is addressed in forward scan and subsequently the second memory portion is addressed recyclically in forward and rearward scans to generate an output waveform having a first part corresponding to the rising waveform section and a second part corresponding to a series of the recyclically addressed versions of the equalized waveform section. After delivery of the first part of the output waveform, a monotonically declining envelope is impressed upon the amplitudes and the spectral energy distributions of the second part.

18 Claims, 8 Drawing Figures

PERIODIC WAVE FORM GENERATION BY RECYCLICALLY READING AMPLITUDE AND FREQUENCY EQUALIZED DIGITAL SIGNALS

This application is a continuation of Application Ser. No. 664,490, filed Oct. 24, 1984 and now abandoned.

BACKGROUND OF THE INVENTION

The present invention relates generally to electronic musical instruments, and in particular to an electronic musical instrument which generates an aperiodic musical waveform from a plurality of digital amplitudes corresponding to sample points in the original aperiodic waveform.

It is known to construct an electronic musical instrument using a digital memory in which an audio waveform is stored in sampled form. The stored audio waveform is conventionally read out of the memory at a constant rate in response to an address counter and is then converted to an analog signal by a digital-to-analog converter. In systems of this type it is desirable to store the digital samples using as few binary digits as possible in order to minimize the cost of the memory. In the case of periodic waveforms, it is common to store digital samples defining only one period of the waveform, the remainder of the waveform being derived through calculations performed on the stored samples. Audio waveforms which are not periodic in nature, such as complex percussive waveforms which decay gradually with time, cannot, however, be treated in this manner. In order to faithfully reproduce such waveforms using the sequential sampling technique, it is necessary to store substantially the entire waveform in sampled form.

Percussive waveforms have a rapidly rising portion generated in response to the occurrence of a crash of cymbals, for example, and an exponentially decaying portion which rapidly decreases at first and then decays more and more slowly with time. The early stages of the waveform have a larger harmonic content than the later stages of the waveform. One approach that has hitherto been proposed involves storing the early stages of the waveform in digital form by eliminating the exponentially decaying tail portion and reading the stored digital samples in a forward scan at first and then recyclically repeating forward and rearward scans to read a portion of the memory having a lesser harmonic content. Since the capacity of the memory needed to store such waveforms is determined by the number of bits required to resolve the highest peak of the waveform multiplied by the number of sample points on the time axis proposed system is still not satisfactory.

A further disadvantage is that the resolution of lower amplitudes peaks of the waveform is not satisfactory in comparison with the resolution of higher amplitude peaks.

SUMMARY OF THE INVENTION

Accordingly, the present invention provides an electronic musical instrument wherein a memory is utilized to the fullest capacity.

According to the invention, the rapidly decaying section of a typical aperiodic waveform is equalized in amplitude and spectral energy distribution to the highest peak of the waveform prior to the processes of sampling and recording the equalized waveform section. A plurality of amplitude data are stored at respective addresses of first and second portions of a memory. The amplitude data stored in the first memory portion represent the amplitudes and spectral characteristic of the non-equalized rising section of the waveform and those stored in the second memory portion represent the amplitudes and spectral characteristic of the equalized, rapidly decaying section. The first memory portion is addressed in forward scan and subsequently the second memory portion is addressed recyclically in forward and rearward scans to generate an output waveform having a first part corresponding to the rising section of the original waveform and a second part corresponding to a series of the recyclically addressed versions of the equalized section of the original waveform. After delivery of the first part of the output waveform, a monotonically decaying envelope is impressed upon the amplitudes of the second part of the output waveform and a monotonically decaying characteristic is impressed upon the spectral energy distributions of the second part of the output waveform.

The equalization of amplitudes and spectral characteristic and the recycled back-and-forth scan reading of the equalized digital samples permit full utilization of a memory and result in an improvement in signal-to-noise ratio. The aperiodic waveform generator of the invention thus requires a memory having a smaller capacity than is required by prior art waveform generators.

BRIEF DESCRIPTION OF THE DRAWINGS

The present invention will be described in further detail with reference to the accompanying drawings, in which.

DETAILED DESCRIPTION

Figure 1:
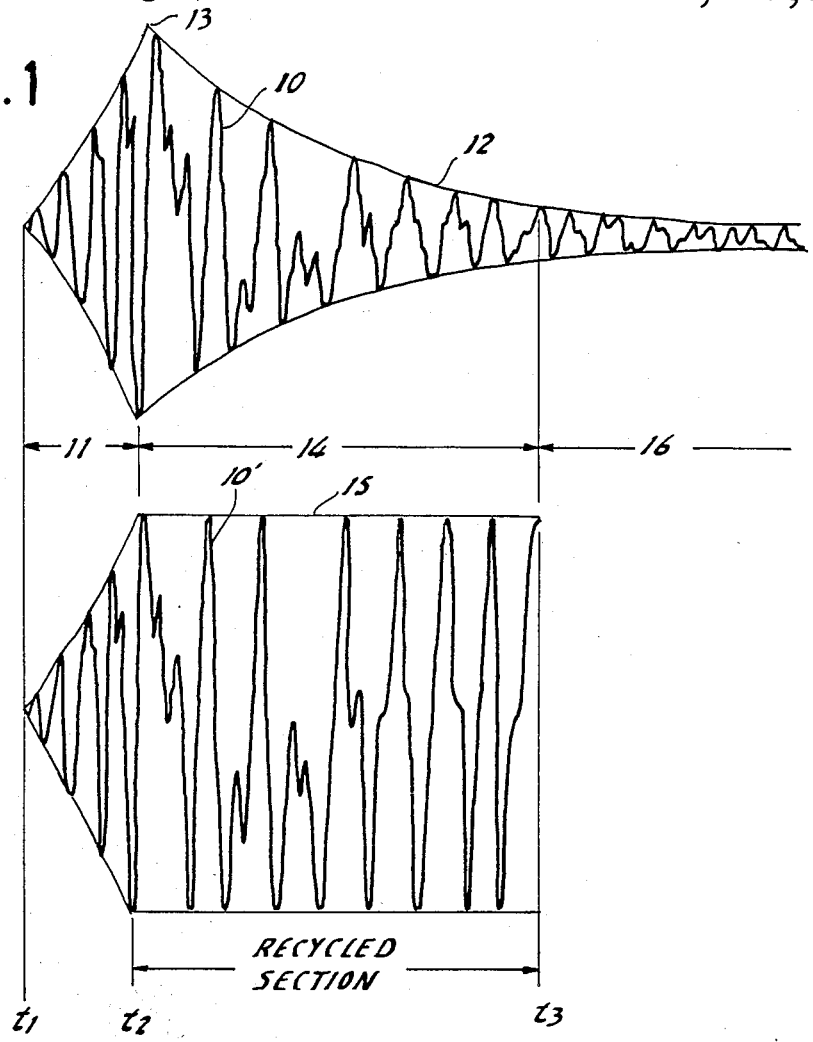
FIG. 1 shows a portion of a typical percussive waveform.
Figure 2:
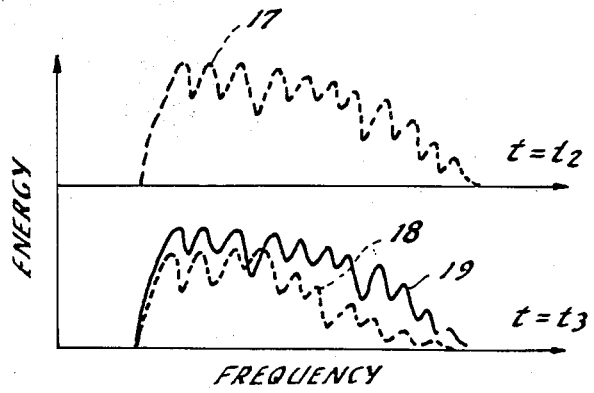
FIG. 2 shows spectral characteristics of digital samples at scan reversal points.

In FIG. 1, the waveform 10 depicts an oscillating voltage which represents a percussive musical sound which is encountered when there is a clash of cymbals. The envelope of the voltage has a sudden onset 11 and a very long exponential decay 12. The envelope rises in response to the occurrence of a percussive event at time $t_1$ to a peak 13 at time $t_2$ and then decays rapidly at first, and then more and more slowly as the waveform continues. There is a larger content of higher harmonics in the rapidly rising portion of the waveform than there is during the remaining portion of the exponential decay. The waveform 10 has a different spectral characteristic at each sample point on the time axis of the waveform such that higher harmonic content decreases monotonically with time. A dashed line curve 17 in FIG. 2 indicates the spectral distribution of energy at 17 at sample point $t_2$ and a dashed line curve 18 indicates the energy distribution at sample point $t_3$ having a lesser content of higher harmonics than at sample point $t_2$.

The waveform generation technique according to the present invention involves recording a portion of the waveform including rapidly rising portion 11 between times $t_1$ and $t_2$ and rapidly decaying portion 14 between times $t_2$ and $t_3$. This is accomplished by first recording the waveform portions 11 and 14 into a suitable recording medium and the rapidly decaying portion 14 is extracted to be processed with respect to amplitude and frequency. This involves equalizing the amplitude to the level of peak 13 as shown at 15 in FIG. 1 using a digital technique. The spectral characteristics of the waveform section 14 are equalized at all sample points to the spectral energy distribution at sample point $t_2$ as indicated by solid-line curve 19 using Fast Fourier Transform. The waveform section 11 which is stored in the original recording medium is reproduced and recombined with the amplitude-and-frequency equalized section 14 to produce an oscillating voltage 10' and converted to a series of digital amplitudes each being identified by an address code.

Figure 3:
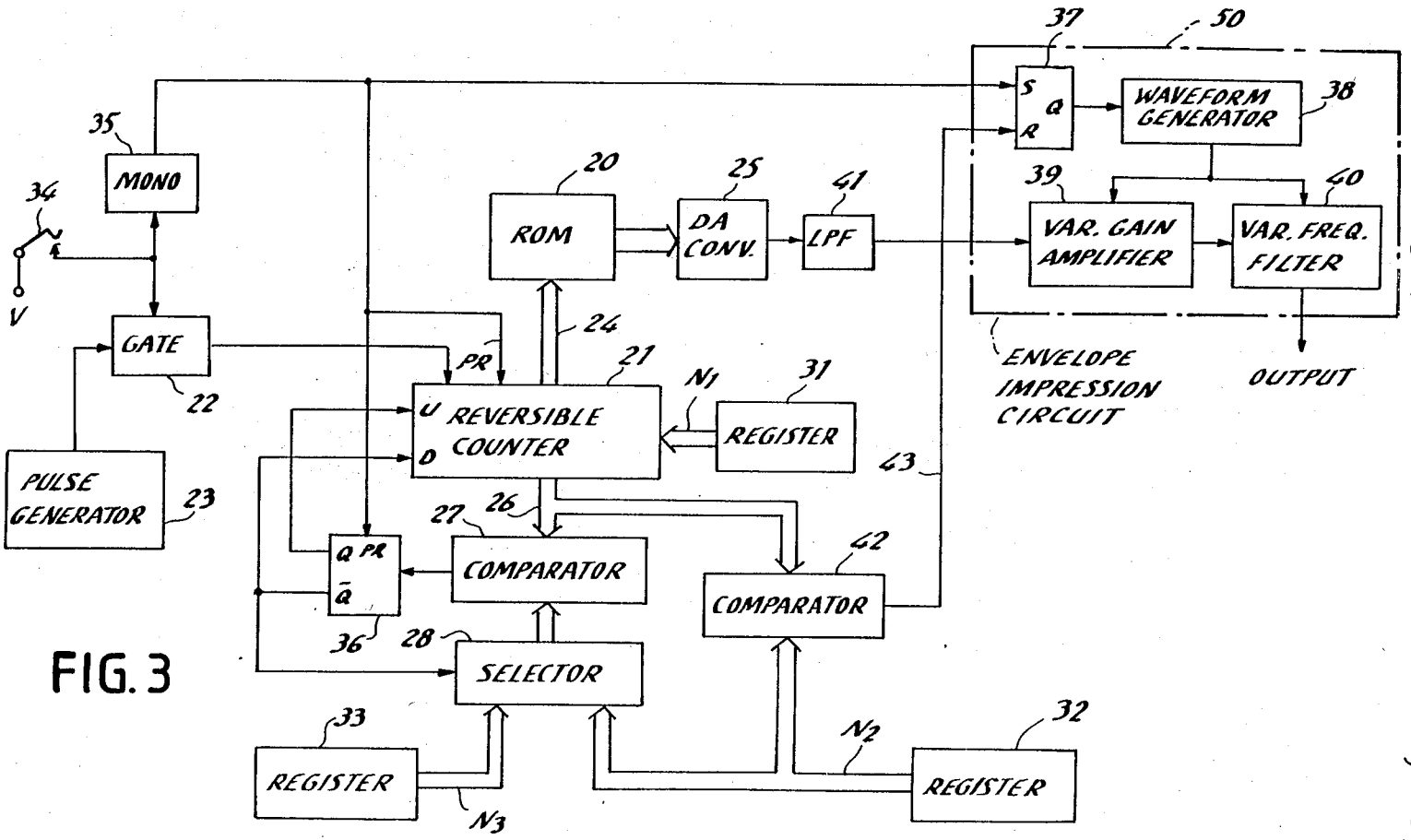
FIG. 3 is a block diagram of the electronic musical instrument according to an embodiment of the present invention.

FIG. 3 illustrates a block diagram of an aperiodic musical waveform generator according to an embodiment of the invention. In FIG. 3, the waveform generator includes a waveshape memory 20, normally a read-only memory (ROM), into which the above-mentioned digital amplitudes are stored in respective memory locations. The digital amplitudes corresponding to successive sample points of the voltage 10' in the waveform section 11 are stored in respective memory addresses of a first portion of memory 20 and those in the waveform section 14 are stored in respective memory addresses of a second, recycled portion of the memory. The digital peak amplitudes stored in the recycled portion of the memory are the same and the spectral characteristics of the digital amplitudes stored in this recycled portion are equalized. These memory addresses are sequentially accessible by corresponding address codes developed on bus 24 by a reversible address counter 21 which is stepped through its successive count states by a clock signal supplied through a gate 22 from a clock pulse generator 23. The same address codes are sequentially developed on bus 26 and applied to a digital comparator 27 for comparison with boundary address counts $N_2$ and $N_3$ presented from the one of registers 32 and 33 which is selected by a selector 28.

The gate 22 is open in response to operation of a key 34 to apply clock pulses to counter 21. The operation of key 34 also triggers a monostable multivibrator 35 which in turn presets counter 21 to an initial address count $N_1$ provided from a register 31. The initial address count $N_1$ corresponds to the memory location of waveshape memory 20 in which the digital amplitude representative of voltage 10' at time $t_1$ is stored. Register 31 could, of course, be dispensed with if the digital amplitude at $t_1$ is stored in zero address location of memory 21 and counter 21 is preset to zero address count.

The output of monostable multivibrator 35 is also applied to the preset input of a flip-flop 36 and to the set input of a flip-flop 37 of an envelope impression circuit 50. The signal on the true output of flip-flop 36 now goes high and sets the reversible counter 21 to upward count mode and the signal on the complementary output of flip-flop 36 goes low and causes selector 28 to apply the boundary address count $N_3$ from register 33 to comparator 27.

Counter 21 starts incrementing its count in response to the gated clock pulses beginning with the initial count state $N_1$ to sequentially scan the address field of waveshape memory 20 in which the digital amplitudes are stored. Digital amplitudes stored in memory locations corresponding to address counts $N_1$ through $N_2$ are sequentially read out of memory 20 as counter 21 is stepped through its count states in upward direction and digital amplitudes stored in a portion of the address field between address counts $N_2$ and $N_3$ is scanned in a forward direction as counter 21 is further incremented.

When counter 21 develops an address count on bus 26 corresponding to boundary address $N_3$ during the initial forward scan, there is a correspondence between the outputs of counter 21 and register 33 and comparator 27 now provides an equality pulse to flip-flop 36. The complementary output of flip-flop 36 goes high and sets the counter 21 into downward count mode and causes the selector to apply the boundary address count $N_2$ of register 32 to comparator 27.

Counter 21 initiates decrementing its count beginning with memory location $N_3$ to rescan the waveshape memory 20 in the opposite direction. Digital amplitudes stored in the recycled portion of the address field of memory 20 are rescanned in a rearward direction. Comparator 27 provides an equality pulse when amplitude instruction on location $N_2$ is read from memory 20. Counter 21 reverses its count direction and selector 28 switches to register 33. This process is repeated as long as the key 34 is depressed, producing a series of alternately reversed versions of waveform section 15. The digital amplitudes sequentially read out of memory 20 are applied to a digital-to-analog converter 25 to produce a series of analog amplitudes in step with the clock pulses. A low-pass filter 41 integrates the analog amplitudes so that transitions between successive analog amplitudes at sample points are smoothed.

Figure 4:
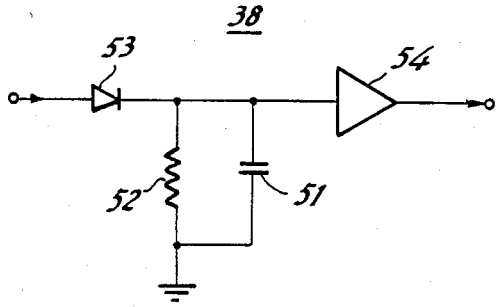
FIG. 4 is a circuit diagram of the waveform generator of FIG. 3.
Figure 5:
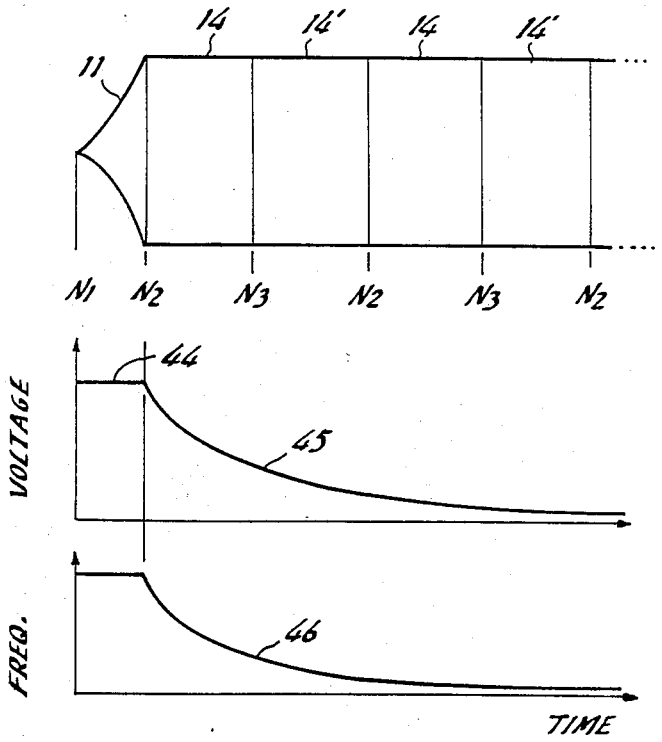
FIG. 5 is a waveform diagram useful for describing the operation of envelope superimposition.

The aperiodic waveform generator of the present invention further includes a second comparator 42 which takes its inputs from reversible counter 21 and register 32. In the initial upward count beginning with initial address $N_1$, comparator 42 produces an equality pulse when the count state in counter 21 reaches the boundary address $N_2$. This equality pulse is applied on conductor 43 to the reset input of flip-flop 37. Since this flip-flop was set in response to the operation of key 34, the signal on the Q output is high until the boundary address $N_2$ is accessed. Accordingly, during the initial section 11 of the analog waveform, flip-flop 37 remains in its initially set condition and a high level output appears on the input of a waveform generator 38. As shown in FIG. 4, waveform generator 38 includes a parallel combination of capacitor 51 and resistor 52 connected through a diode 53 from the Q output of flip-flop 37 to ground. The high voltage signal from flip-flop 37 charges capacitor 51, developing a voltage plateau 44 (FIG. 5) as long as the Q output of flip-flop 37 remains high. The resetting of flip-flop 37 by the output of comparator 42 causes capacitor 51 to discharge through resistor 52, developing an exponentially decaying voltage 45. The envelope thus generated is coupled through a buffer amplifier 54 to the control terminals of an analog multiplier, typically a variable gain amplifier 39, and a variable frequency filter 40.

Variable gain amplifier 39 takes its input from the low-pass filter 41 to impress the envelope developed by waveform generator 38 upon the analog amplitudes by a variable ratio which ranges from unity to zero. Amplifier 39 provides a unity gain amplification when it is supplied with the voltage plateau and reduces its gain in proportion to the decaying voltage. Thus, the reconstructed initial waveform section 11 is unaffected by variable gain amplifier 39 and the subsequent portion of the reconstructed waveform comprising a series of recycled waveform sections 14 and 14' are reduced monotonically by the exponentially decaying voltage 45.

The output of variable gain amplifier 39 is applied to variable frequency filter 40. This filter has the characteristic of a low-pass filter. However, the cut-off frequency of this low-pass filter follows a curve shown at 46, FIG. 5; namely, it shifts toward lower frequency in proportion to decaying voltage 45. The output of variable gain amplifier 39 has an equalized spectral characteristic since it only affects the amplitude of the analog signal. Variable frequency filter 40, on the other hand, modifies this frequency characteristic in accordance with the decaying waveform so that the harmonic content of the reconstructed analog waveform decreases monotonically with time. Since the original waveform sections 11 and 14 have a larger content of higher harmonics than in the tail portion 16 of the waveform diagram of FIG. 1, the spectral characteristic of the output of variable frequency filter 40 substantially conforms to the spectral characteristic of the original waveform. The monotonic decrease both in amplitude and higher harmonic content approximates the waveform generated according to the present invention to natural percussive sounds. In addition, the period of the recycled waveform section is longer than the minimum period of the audible frequency. As a result, there is no audible flutter frequency in the regenerated aperiodic waveform.

Figure 6:
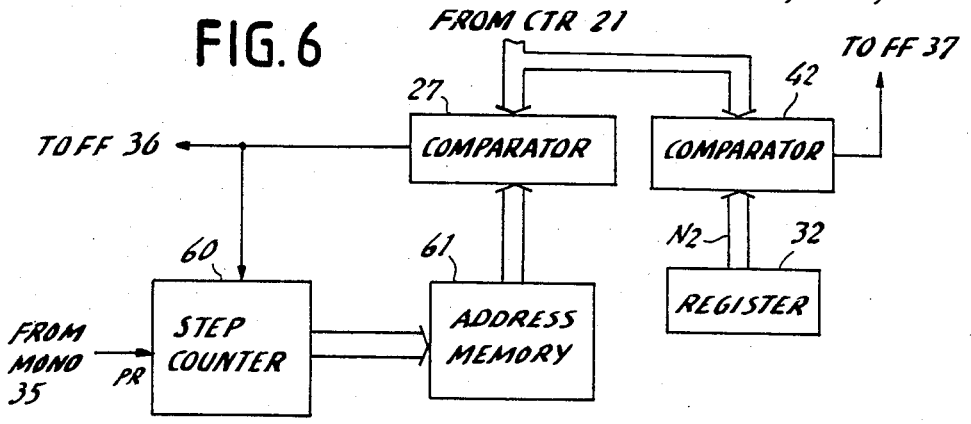
FIG. 6 is a block diagram of a modified embodiment.

FIG. 6 shows an alternative form of the previous embodiment. Selector 28 and register 33 are replaced with a step counter 60 and an address memory 61. Step counter 60 is preset by the output of monostable multivibrator 35 to an initial count from which it beings to count up in response to the output of comparator 27. Address memory 61 may store a series of address codes $N_3$ and $N_2$ to read the address field of memory 20 in a manner identical to the previous embodiment. However, the flexibility of memory 61 allows a series of pseudo-random address codes to be stored and accessed in sequence to scan different sections of the recycled portion of the waveform. For example, the pseudo-random codes may include a boundary address $N_3$ for reversal at the end of initial forward scan and a boundary address $N_2$ for reversal at the end of first rearward scan and subsequent boundary addresses which are randomly located between the boundary addresses $N_2$ and $N_3$. As a result of this pseudo-random addressing, portions of different length in the waveform section 14 are rescanned so that each scan partially overlaps adjacent scans.

Analog amplitudes developed on the output of low-pass filter 41 during rearward scan form a waveform which retraces the voltage developed during forward scan. To ensure smooth transition at reversal of any polarity (from a scan of a given direction to a scan of opposite direction) it is preferable that the reversal point should correspond to the crest or trough of the oscillating voltage. In the case of the waveform of FIG. 1 this is accomplished by storing a digital "trough" instruction in the boundary address $N_2$ and a "crest" instruction in the boundary address $N_3$.

Figure 7:
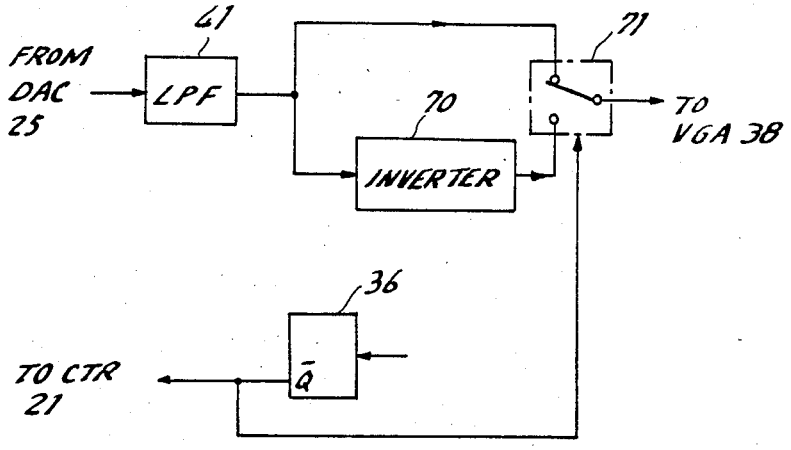
FIG. 7 is a block diagram of a further modification of the invention.
Figure 8:
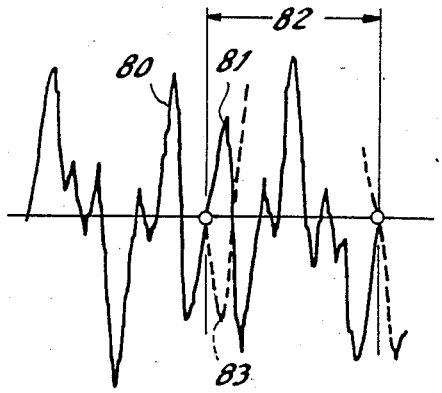
FIG. 8 is a waveform diagram associated with FIG. 7.

In an alternative embodiment, boundary address codes correspond to each zero crossover point of the oscillating voltage 10'. The present invention accomplishes this by alternately inverting the polarity of the analog waveform to avoid rapid transition at reversal points. FIG. 7 illustrates an inverter 70 coupled to the output of low-pass filter 41 and a switch 71 which alternately pass the outputs of low-pass filter 41 and inverter 70 in response to the complementary output of flip-flop 36 to variable gain amplifier 39. As illustrated in FIG. 8, reconstructed analog waveform 81 retraces the preceding waveform 80 during subsequent scan 82 without rapid transitions which would otherwise occur as shown at 83 if the circuit of FIG. 7 is not provided.

The foregoing description shows only preferred embodiments of the present invention. Various modifications are apparent to those skilled in the art without departing from the scope of the present invention which is only limited by the appended claims. For example, the envelope impression circuit may be constructed of a digital circuit to multiply a digital multiplication factor upon digital amplitudes delivered form the waveshape memory 20. Variable frequency low-pass filter could equally be as well constructed of a digital filter to modify the frequency characteristic of the digital amplitudes from the memory.

We claim:

1. An electronic musical instrument for generating an aperiodic waveform having a series of consecutive sections including a rapidly rising section having a larger content of higher harmonics, a rapidly decaying section having a lesser content of said higher harmonics and a gradually decaying section having a least content of said higher harmonics, said aperiodic waveform having a spectral distribution profile which varies as a function of time elapsed from onset of said rapidly rising section, comprising:

a memory having a first portion storing data representing amplitudes and spectral distribution profiles of only said rising section and said rising section and a second portion storing data representing scaled amplitudes of only said rapidly decaying section, said scaled amplitudes having peaks equal to the amplitude at a transition between said rapidly rising section and rapidly decaying section, the data stored in said second portion further representing scaled spectral distribution profiles each of which is substantially equal to the spectral distribution profile at said transition;

first means for addressing said first portion of the memory in a forward scan for generating a first output waveform and subsequently addressing said second portion recyclically in forward and rearward scans for generating a second output waveform;

second means for impressing a monotinically decaying envelope upon said second output waveform; and third means for impressing a monotonically decaying spectral distribution profile upon said second output waveform, said second and third means being connected in circuit to said memory to combine said first output waveform with the outputs of said second and third means thereby to generate a replica of said aperiodic waveform.

2. An electronic musical instrument as claimed in claim 1, wherein said first means comprises:

a reversible counter for addressing said memory addresses in forward and rearward scans; and means for reversing said forward scan at a first address limit of the memory addresses and reversing said rearward scan at a second address limit of the memory addresses and repeating the reversals at said first and second address limits.

3. An electronic musical instrument as claimed in claim 2, wherein each of said first and second address limits corresponds to a crest or a trough of the second section of the original waveform.

4. An electronic musical instrument as claimed in claim 2, wherein each of said first and second address limits corresponds to a zero crossover point of the second section of the original waveform, further comprising means for inverting the polarity of said output waveform at alternate ones of said address limits.

5. An electronic musical instrument as claimed in claim 2, further comprising means for detecting the initial forward scan reaching said second address limit, wherein said second and third means comprise a waveform generator responsive to the detection of said initial forward scan reaching said second address limit to generate a signal having a monotonically declining amplitude, said second means comprising a multiplier for multiplying said second part of the output waveform by a fraction which is a function of said monotonically declining amplitude, and said third means comprising a variable frequency low-pass filter for passing said second part of the output waveform therethrough, the cut-off frequency of the low-pass filter being decreased as a function of said monotonically declining amplitude, said multiplier and said variable frequency low-pass filter being connected in circuit to said memory.

6. An electronic musical instrument as claimed in claim 1, wherein said first means comprises:

a reversible counter for sequentially generating a data address code to access said memory addresses in forward and rearward scans;

an address memory with a plurality of address limit codes respectively stored in sequentially addressible memory locations;

a second counter for sequentially accessing said memory locations; and a comparator coupled to said reversible counter and to said address memory to generate a coincidence output representing the occurrence of a coincidence between the data address code and the address limit code accessed by said second counter and stepping said second counter in response to said coincidence.

7. A method for generating an aperiodic waveform having a series of consecutive sections including a rapidly rising section having a larger content of higher harmonics, a rapidly decaying section having a lesser content of said higher harmonics and a gradually decaying section having a least content of said higher harmonics, said aperiodic waveform having a spectral distribution profile which varies as a function of time elapsed from onset of said rapidly rising section, comprising the steps of:

storing data into first and second portions of a memory, the data stored in said first portion representing amplitudes and spectral distribution profiles of only said rising section and the data stored in said second portion representing scaled amplitudes of only said rapidly decaying section, said scaled amplitudes having peaks equal to the amplitude at a transition between said rapidly rising section and rapidly decaying section, the data stored in said second portion further representing scaled spectral distribution profiles each of which is substantially equal to the spectral distribution profile at said transition;

addressing said first portion of the memory in forward scan for generating a first output waveform;

addressing said second portion of the memory recyclically in forward and rearward scans for generating a second output waveform; and impressing a monotonically decaying envelope and a monotonically decaying spectral distribution profile upon sAid second output waveform.

8. In a waveform generating system: for synthesizing an aperiodic waveform having a first, rapidly rising portion, a second, rapidly decaying portion, and a third portion, said third portion decaying more slowly than said second portion, the system including storage means for storing data samples representative of samples of said aperiodic waveform, the improvement comprising:

means in said storage means for storing data samples representative of equalized samples of at least one portion of said aperiodic waveform, said samples equalized in amplitude and spectral characteristics, first means for reading out stored data samples representing said first portion of said waveform and for reproducing an output analog signal representative thereof, second means for reading out stored data samples representing said second portion of said waveform and for reproducing an output analog signal representative thereof, third means for thereafter recyclically reading out said stored data samples representing said second portion of said waveform and for reproducing an output analog signal representative of said third, slowly decaying portion of said waveform, and fourth means for reconstructing said aperiodic waveform from said stored equalized data samples, including restoring means for restoring signals reproduced in response to said read out equalized samples for incorporation in said aperiodic waveform.

9. An improved waveform generating system as recited in claim 8 further comprising:

reversible up/down counting means for generating addresses for accessing said stored data samples from said storage means, switch key means connected for causing said reversible up/down counting means to count in a first direction and for passing clock pulses thereto, said switch key means further operable for presetting said reversible up/down counting means to a first value representative of an address of a sample of said aperiodic waveform at an initial time at a beginning of said first portion thereof, said reversible up/down counting means connected to provide address locations to said storage means for providing said data samples to said fourth means, and said third means comprising reversing means for reversing a count direction of said reversible up/down counting means thereby to recyclically access data samples from said storage means representing said second portion of said waveform to reproduce said third portion thereof.

10. An improved waveform generating system as recited in claim 9 wherein said reversing means comprises comparing means for comparing said address locations generated by said reversible up/down counting means with predetermined address limits therefor representing storage addresses for beginning and end points of said second portion of said waveform, said reversing means operable for reversing the direction of count of said reversible up/down counting means upon determining that an address location generated thereby equals one of said predetermined address limit.

11. An improved waveform generating system as recited in claim 10 wherein said comparing means includes selecting means for selecting an output of one of two registers for comparison with the count of said reversible up/down counting means as address limits therefor in accordance with the direction of count of said reversible up/down counting means.

12. An improved waveform generating system as recited in claim 10 wherein said reversing means comprises flip-flop means toggled by said comparing means, said flip-flop means providing outputs for controlling said direction of count of said reversible up/down counting means and for selecting an output of one of two registers for comparison with the count of said reversible up/down counting means as address limits therefor in accordance with the direction of count of said reversible up/down counting means.

13. An improved waveform generating system as recited in claim 10 wherein said restoring means comprises second comparing means responsive to said reversible up/down counting means and to one of said address limits for generating a steady voltage level for data samples in said first, rapidly rising, portion of said aperiodic waveform and for generating a decaying voltage level for sample representing said equalized rapidly decaying portion thereof, and combining means for combining said decaying voltage with the equalized samples representing said rapidly decaying portion of said waveform to generate said rapidly decaying waveform therefrom.

14. An improved waveform generating system as recited in claim 13 wherein said combining means includes amplitude modifying means responsive to said decaying voltage level for modifying amplitudes of samples retrieved from said storage means and spectrum modifying means responsive to said decaying voltage level for modifying spectral characteristics of samples retrieved from said storage means thereby to approximate said aperiodic waveform.

15. An improved waveform generating system as recited in claim 10 including step counting means and address memory means responsive to said step counting means for providing a series of address codes for reading said data samples from said storage means.

16. An improved waveform generating system as recited in claim 15 including random generating means for randomly generating limit addresses for reversals of read-out directions of sequences of said data samples from said storage means, said limit addresses randomly located between first and second reversal addresses, thereby to rescan partially overlapping sequences of different lengths of data samples from said storage means.

17. An improved waveform generating system as recited in claim 16 further including means for providing smooth transitions of said generated output waveform at said address limits.

18. An improved waveform generating system as recited in claim 8 wherein said means in said storage means for storing data samples representative of equalized samples of at least one portion of said aperiodic waveform is operable for storing equalized samples of only said second portion of said aperiodic waveform.

* * * * *